US005987916A

United States Patent [19]

Egbert

[11] Patent Number: 5,987,916

[45] Date of Patent: Nov. 23, 1999

[54] SYSTEM FOR SUPERMARKET REFRIGERATION HAVING REDUCED REFRIGERANT CHARGE

[76] Inventor: Mark Egbert, 18 Orchard Pl., Bernville, Pa. 19506-9587

[21] Appl. No.: 08/934,573

[22] Filed: Sep. 19, 1997

[51] Int. Cl.[6] ..... F25B 39/00

[52] U.S. Cl. ..... 62/498; 62/525; 62/528; 62/278

[58] Field of Search ..... 62/151, 196.4, 62/238.6, 238.7, 277, 278, 498, 504, 511, 525, 527, 528

[56] References Cited

U.S. PATENT DOCUMENTS

| | | | |
|---|---|---|---|
| 2,084,755 | 6/1937 | Young, Jr. | 62/525 X |
| 2,126,364 | 8/1938 | Witzel | 62/525 |
| 2,164,761 | 7/1939 | Ashley | 62/511 X |
| 2,229,940 | 1/1941 | Spofford | 62/525 |
| 3,150,498 | 9/1964 | Blake | 62/278 X |
| 3,392,542 | 7/1968 | Nussbaum | 62/278 X |
| 3,822,562 | 7/1974 | Crosby | 62/278 X |
| 4,955,207 | 9/1990 | Mink | 62/238.6 |

*Primary Examiner*—Harry B. Tanner
*Attorney, Agent, or Firm*—Eugene E. Renz, Jr.

[57] ABSTRACT

A compression type refrigeration system having a compressor, a condenser and an evaporator positioned remotely from the condenser, a liquid feed line connecting the condenser outlet with the evaporator inlet, said feed line having a length, and an expansion device located in the liquid feed line and positioned remotely from the evaporator. Where multiple evaporators are employed a novel distributing device is employed to divide the main refrigerant stream flowing in the liquid feed line between the expansion device and the evaporators into sub-streams which flow to each of the multiple evaporators. A hot gas defrost is provided which is designed to avoid condensation of refrigerant within the defrosting evaporator.

26 Claims, 3 Drawing Sheets

SYSTEM FOR SUPERMARKET REFRIGERATION HAVING REDUCED REFRIGERANT CHARGE

FIELD OF THE INVENTION

The present invention relates to refrigeration systems employing a compressor, condenser and evaporator and more particularly to such systems employing a volatile refrigerant circulated by the compressor; and still more particularly to such systems of the so-called direct expansion type: That is; systems employing evaporators of the "flow-through" type, having no pool of refrigerant residing therein.

The invention relates further to such systems having a substantial distance between the condenser and the evaporator since systems of this type normally require a large mass or weight of refrigerant to operate successfully.

The invention relates further to such systems employing evaporators whose cooling surfaces accumulate frost and therefore periodically require defrosting.

The invention relates further to such systems which include means for collecting, storing at one time and dissipating for useful purposes at another time such heat which is discharged by the compressor.

The invention relates further to such systems employing either two separate aircooled condensers or one aircooled condenser having two refrigerant condensing circuits and to a valve arrangement which feeds refrigerant to be condensed to both circuits or condensers or to only one.

The invention relates further to such systems employing a hot gas defrost with means for preventing refrigerant condensation in the defrosting evaporator.

BACKGROUND OF THE INVENTION

There was a time not long past when refrigerants, commonly used in large systems for warehouses and supermarkets, such as dichloro-difluoro methane, known in the trade as R-12, cost less than one dollar per pound and lubricants of the type employed with R-12 cost less than a dollar per gallon.

Subsequently it was found that the concentration of stratospheric ozone was declining, especially in the Antarctic regions. Many scientists believed that R-12 and similar fully substituted chlorfluorocarbons (CFC's) were escaping from refrigeration systems and from industrial processes which employed them and were migrating to the stratosphere where the chlorine atoms in these chemicals attacked and destroyed the ozone present there.

Governments decreed that the production of such chemicals stop. To satisfy the demand for refrigerants for comfort and process and food cooling and freezing, a group of chemicals which employed fluorine but had no chlorine was developed (–FC refrigerants). These new –FC refrigerants cost ten or more times greater than the prebanned price for the old CFC refrigerants. The old low cost oils were believed to not work correctly with the new –FC refrigerants and new oils were developed. Instead of costing only a few dollars per gallon, the new oils such as polyolester (POE) chemicals cost much more.

It was found that the greater the mass of refrigerant required to be charged into a system to make it function correctly, the greater the volume of lubricant was needed to satisfy the requirements of the compressor.

Therefore efforts were directed to designing systems which employed less refrigerant, thereby requiring less of the new lubricant and thus providing the dual benefit of reduced aggregate cost for both as well as sharply reduced risk of loss in the event of a serious refrigerant leak.

SUMMARY OF THE INVENTION

A compression type refrigeration system having a compressor, a condenser having an outlet and an evaporator having an inlet, said evaporator being positioned remotely from the condenser. A condenser outlet conduit is provided, having an overall length, for conveying condensed refrigerant from the condenser outlet to the evaporator inlet. The overall length of the condenser outlet conduit is divided into a two portions, a first portion connected to the condenser outlet and a second portion connected to the evaporator inlet. The length of the first portion is 90 percent of the overall length. An expansion valve is positioned in the first portion of said condenser outlet conduit for reducing the pressure and temperature of said refrigerant flow.

BRIEF DESCRIPTION OF THE DRAWINGS

The foregoing summary as well as the following description of preferred embodiments of the invention, will be better understood when read in conjunction with the appended drawings. For the purpose of illustrating the invention there are shown in the drawings embodiments which are presently preferred, it being understood, however, that the invention is not limited to the specific instrumentalities or the precise arrangement of elements disclosed.

DETAILED DESCRIPTION OF THE INVENTION

Figure 1:
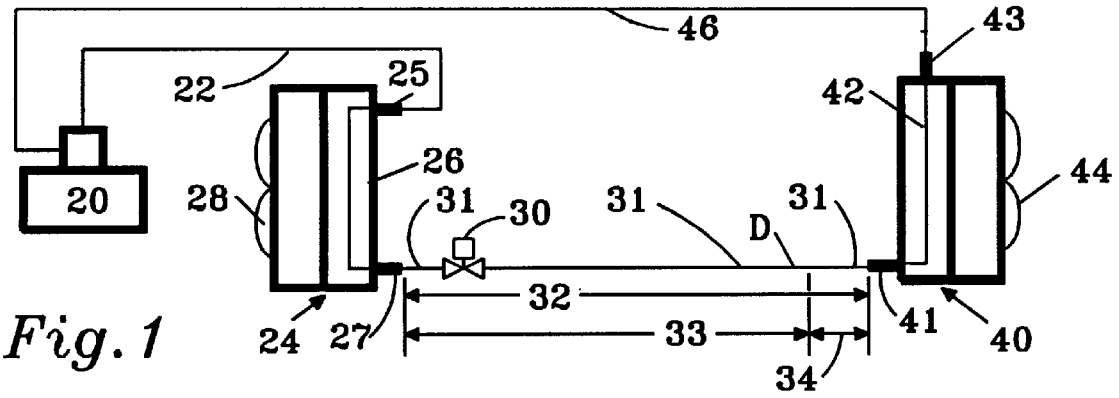
FIG. 1 is a schematic piping diagram of an embodiment of the present invention showing a single compressor, single condenser and single evaporator with a condenser outlet conduit connecting the condenser and evaporator.

Referring now to the drawings, wherein like references are used to indicate like elements, there is shown in FIG. 1 a schematic piping diagram for a compression type refrigerating system including compressor 20 and a discharge conduit 22 for receiving hot compressed high pressure refrigerant discharged by the compressor. The discharge conduit 22 is connected to deliver the compressed refrigerant vapor to condenser 24. The condenser 24 includes a condenser coil 26 having an inlet 25 and an outlet 27. A flow of air is provided over condenser coil 26 by fan 28. Within the condenser coil 26 heat from the refrigerant is transferred to the air flow, thereby cooling and condensing the refrigerant to a hot liquid and simultaneously heating the air flow.

The hot liquid refrigerant leaves the condenser via condenser outlet 27.

Though an air-cooled condenser is shown, the principles of the present invention are independent of the type of condenser employed. For instance, a water cooled condenser or an evaporative condenser may be employed instead of an air-cooled condenser, yet the principles embodied in my invention will apply as well.

An evaporator 40 is positioned remotely from the condenser 24. The evaporator 40 includes a cooling coil 42, generally equipped with tubes and fins (not shown) and a fan 44 to circulate the air to be cooled through the evaporator coil 42. The evaporator may be of a type which is employed to cool an enclosure, such as a freezer box or walk-in cooler, or it may be of the type that is built into a display fixture for keeping milk or fresh vegetables cool; or it may be of the type that air-conditions a meat cutting room. In all the above examples the evaporator is of the type which cools air. However, the evaporator may not be designed to cool air at all. It may be employed to chill water or to make ice or chill brine. In other words the principles of my invention will apply to any kind of evaporator, designed or employed for any purpose.

In order to cause the evaporator to cool, a supply of liquid refrigerant must be supplied to it. For this purpose a condenser outlet conduit or liquid feed line 31 is provided which connects the outlet fitting 27 of condenser 24 to the inlet fitting 41 of evaporator 42. The condenser outlet conduit has an overall length 32. The invention is most applicable when the length 32 of the condenser outlet conduit exceeds 10 feet. This length is the actual length of the pipe or tubing employed to connect the condenser outlet fitting 27 with the evaporator inlet fitting 41. Though shown straight in FIG. 1, the condenser outlet conduit 31 may follow any path, straight or crooked. The condenser outlet conduit 31 may convey the liquid refrigerant condensed in condenser 24 to an evaporator inlet connection 41 at the same elevation as the condenser outlet connection 27 or to an evaporator inlet connect positioned at a higher or lower elevation. It is the intention herein that the term length always refers to and means the developed length of the pipe or tubing connecting the terminus points defined. The developed length means the straight length which would be found if every bend were replaced by a straight connection. Where fittings or apparatus, such as heat exchangers or driers are provided in the apparatus, the length of the fittings or apparatus is intended to be included in the developed length.

The condenser outlet conduit 31 is divided into two portions; a condenser outlet portion having a length 33 and an evaporator inlet portion having a length 34. The sum of the lengths of the condenser outlet portion and the evaporator inlet portion is equal to the overall length 32 of the condenser outlet conduit 31.

There may not be any visible or actual joint where the condenser outlet portion connects to the evaporator inlet portion.

In order for the condensed, high pressure, sometimes hot refrigerant liquid produced by condenser 24 to provide effective cooling of the cooling coil or coils in evaporator 42, the pressure of the high pressure liquid refrigerant must be reduced. For this purpose a pressure reducing device is employed. This may take the form of a valve 30 called an expansion valve. In an alternative but equivalent construction a fixed restrictor such as a capillary tube or an orifice is employed in place of the expansion valve. The expansion device, valve or capillary, has always been positioned within the portion 34 of condenser outlet conduit 31 which is immediately adjacent the evaporator inlet connection 41 and in many cases is actually installed within a casing or housing enclosing the evaporator (not shown).

To effect the preferred structure of the present invention, by contrast, the expansion device is never installed in portion 34 of the condenser outlet conduit 31, but is instead installed in the condenser outlet conduit 31 at a position which is substantially adjacent the condenser outlet connection 27, as shown in FIG. 1. In an alternate construction the expansion device 30 is installed in the condenser outlet conduit 31 at any position which is within the portion 33 of the condenser outlet conduit 31 which is NOT adjacent the evaporator inlet 41 and is not within the evaporator adjacent portion 34 of the condenser outlet conduit 31.

The effect of positioning the expansion device close to the condenser outlet, instead of in the conventional position, close to the evaporator inlet, is a substantial reduction in refrigerant charge.

In a typical installation not employing the principle of this invention the expansion valve will be located immediately adjacent the evaporator. In a large supermarket where one hundred tons of air conditioning is required, the roof mounted condenser will be 100 feet from the evaporator. An ASHRAE chart indicates that 1⅜ inch OD copper liquid (condenser outlet) conduit will be required. The internal volume of such a 100 ft. long tube is 0.86 cu. ft. Refrigerant (HCFC) 22, the refrigerant most frequently employed for such an application, has a liquid density at 100 F. of 71 lb./cu. ft. Therefore the refrigerant liquid required to fill such a liquid line (conduit) would be 0.86×71=61 lb. HCFC-22. However, positioning the expansion valve at the condenser outlet, according to the principles disclosed in my invention, the refrigerant charge will drop to 5.9 lb. HCFC-22, a reduction of 90%. This 90% reduction assumes a pressure at the outlet of the expansion valve of 68 psig, corresponding to 40 F., a normal airconditioning evaporator pressure and 100 F. bubble-free liquid entering the expansion valve.

It is acknowledged that such an uninsulated conduit having 40 F. liquid would waste refrigeration effect by needlessly cooling its environment. However, calculation discloses that the losses are very small. Even if the condenser outlet conduit 31 is left uninsulated over its entire 100 ft. length, provided it is located in still air where its heat transfer coefficient to the surrounding still air would be only about 1 Btu/hr-F-sq.ft., the heat gain from a 100 F. environment would be only about 2200 Btu/hr or 0.18% of the 100 ton load. A serious drawback of such a design would be the inevitable sweating of conduit 31 with potential wetting of material positioned under it. However, the application of ½ inch rubber foam insulation to conduit 31, the insulation having a k factor of 0.21 Btu/hr-sq.ft.-F-inch, would reduce the heat gain to about 500 Btu/hr, for a refrigeration loss of only 4/100 of one percent and would effectively eliminate the sweating hazard.

Figure 2:
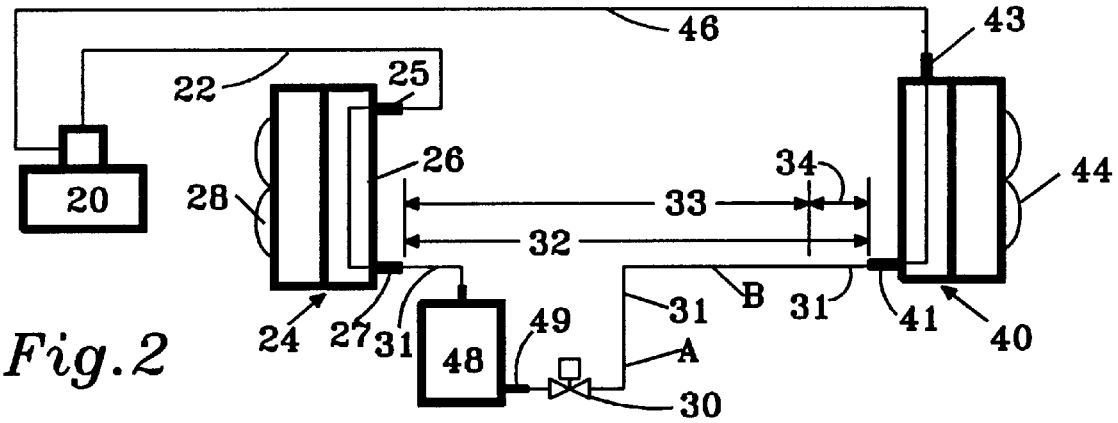
FIG. 2 is a schematic piping diagram of an embodiment of the present invention further including a receiver positioned in the condenser outlet conduit between the condenser and the expansion valve.

FIG. 2 illustrates the application of a liquid receiver to the principle of the invention. In FIG. 2, receiver 48 is positioned within the condenser outlet conduit 31. Its function is to receive liquid refrigerant condensed by condenser 24 and to hold it in a pool until required by the expansion valve 30. The application of liquid receivers is effectively standard in most field erected refrigeration systems.

To apply the principles of the present invention to systems employing a liquid receiver 48, the expansion device 30 is positioned in liquid outlet conduit 31 at the outlet 49 of liquid receiver 48.

Under certain circumstances the system designer or installer may find it desirable to apply the principles of the present invention by installing the expansion device at some position within condenser outlet conduit 31 other than at the immediate outlet 27 of condenser 24, for instance, at a position closer to the evaporator 40, such as at point A or point B or point C, for reasons of access or serviceability or other reasons. Applicants believe that, so long as the expansion valve is positioned in the condenser outlet conduit 31 within that portion defined by the the length 33, substantial benefits will arise from such positioning; benefits which are not secured, or only partly secured, by positioning the expansion device within the evaporator inlet portion 34 of condenser outlet conduit 31 and that such positioning will lie within the scope of the invention.

While the principle of the invention can be effectuated by providing a liquid receiver and positioning the expansion device at its outlet, as shown in FIG. 2, there arises a significant advantage in the application of the invention which makes it both possible and desirable to omit the liquid receiver. The liquid receiver is provided to accommodate major fluctuations in the effective refrigerant charge. These fluctuations are generated by the need to evacuate (or "pump-down") the condenser outlet conduit, which in the prior constructions was full of liquid refrigerant (61 lb. in the 100 ton system described above). However, in the construction defined by the present invention, the same 100 ton system would have a refrigerant charge in the same condenser outlet conduit 31 of only 6.9 lb. This small charge could easily be stored in condenser 24 should a "pump down" of the conduit 31 be required.

Providing a liquid receiver has many negative aspects. The receiver is a high pressure tank which must meet strict design criteria thereby generating significant cost. The receiver has several fittings such as those for relief valves, in addition to those required for inlet and outlet. Therefore, for each fitting there is a potential for leakage. Further, the receiver does not operate empty. It has an operating refrigerant charge which may be 20% of its capacity. Therefore, by applying the structure of the present invention, whereby the receiver can be eliminated, the advantages of reduced cost by eliminating the receiver, reduced potential for leaks by eliminating the receiver fittings and reduced refrigerant charge through eliminating the receiver operating charge are all achieved.

Figure 3:
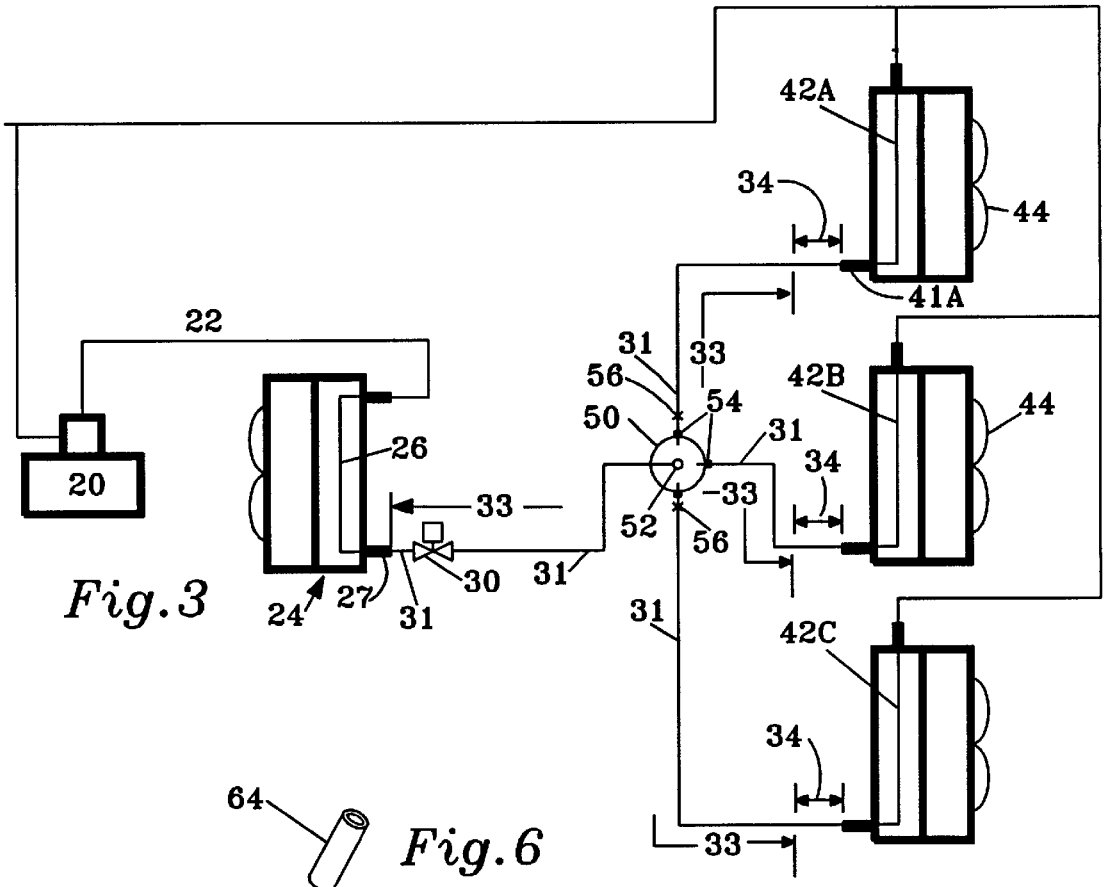
FIG. 3 is a schematic piping diagram of an embodiment of the present invention which includes three evaporators and a distributing device.
Figure 6:
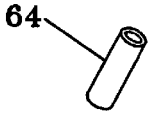
FIG. 6 is a detail of one element of one kind of packing employed in the distributor of FIGS. 4 and 5.

Referring now to FIG. 3 there is shown a schematic piping diagram of a refrigerating system similar to that of FIG. 1 but having three evaporators. Though three evaporators are shown, the principle of the invention will apply for any number of evaporators. Further, the evaporators do not all have to be of the same design or capacity. Evaporators of the type employed in display cases may be combined with other evaporators employed in walk-in coolers. A single expansion valve 30 is positioned in the condenser outlet conduit 31. The low pressure mixture of vapor and liquid discharged from the expansion valve 30 is conveyed via condenser outlet conduit 31 to inlet 52 of distributor 50.

Figure 4:
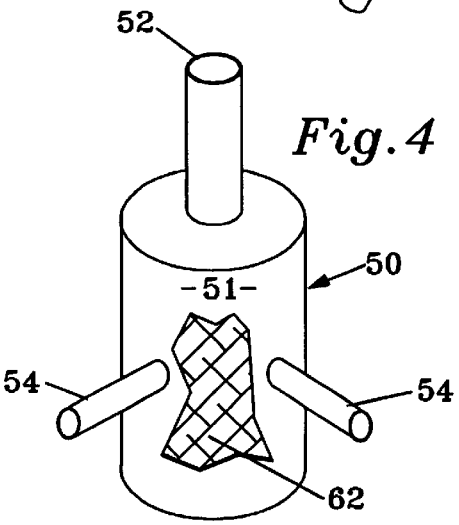
FIG. 4 is an isometric view of the distributing device with a cut away section showing the interior packing.
Figure 5:
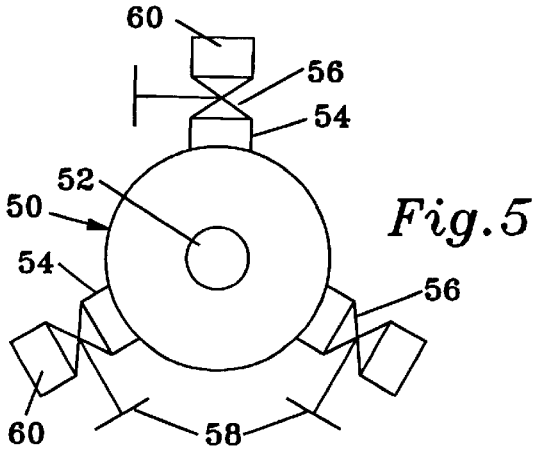
FIG. 5 is a top view of the distributing device showing manual balancing valves.
Figure 7:
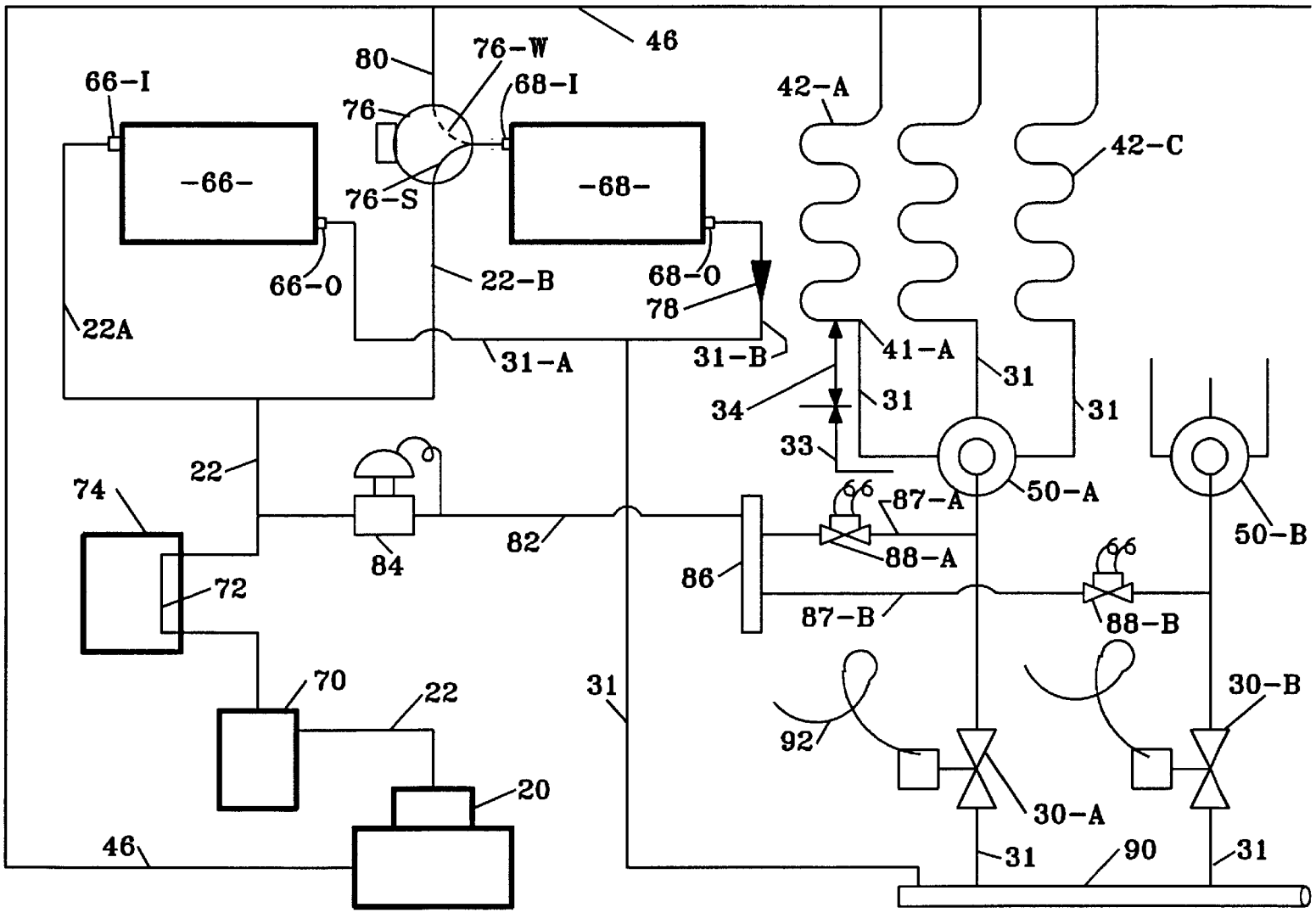
FIG. 7 is a schematic piping diagram of a multiple evaporator refrigeration system having multiple air cooled condensers and means for controlling such condensers and for defrosting the evaporators.

The following refers now to FIGS. 4 and 5 as applied to FIGS. 3 and 7. In order to assure effective and reliable division of the inlet liquid and vapor flow entering distributor inlet 52, to the multiple branch outlets 54 of the distributor 50 for uniform flow to the multiple evaporators 42-A, 42-B and 42-C, the vapor-liquid mixture must be agitated. The agitation is necessary to assure a substantially uniform emulsion of liquid and vapor reaching the distributor branch outlets 54. This agitation is achieved by requiring the vapor-liquid mixture flowing into distributor inlet 52, to traverse a randomly oriented packing positioned with the shell 51 of distributor 50. The packing agitates and mixes the inlet stream into a substantially homogeneous foam-like continuum, before being allowed to exit toward the evaporator via the distributor branch outlets 54.

In order to establish the correct flow of refrigerant vapor-liquid mixture to the multiple evaporators, each of which might have a different capacity and therefore different flow requirement for the vapor-liquid mixture, valves 56 are provided at each branch outlet 54 of distributor 50 whereby the flow through each branch outlet 54/60 can be manually adjusted to the refrigerating needs of each evaporator. Since the relative refrigerating capacities of the several evaporators remain substantially constant, only a single adjustment of the balancing valves 56 is required.

In the multiple evaporator situation, the length of condenser outlet conduit 31 is the sum of the conduit lengths measured from the nearest condenser outlet to the distributor 50 plus the length of each individual branch conduit between the distributor 50 and the specific evaporator inlet. The length of the condenser outlet portion 33 within which resides the non-infringing location of the expansion device is determined from each individual sum.

Referring now to FIG. 7 there is shown a refrigerating system embodying other features of the invention. Elements which are substantially the same as those referred to in earlier figures retain the same numbers.

In FIG. 7 compressor 20 receives refrigerant vapor from suction line 46 and discharges the vapor at high pressure and temperature to discharge line 22. Oil separator 70, is positioned in discharge line 22 to receive the hot refrigerant vapor and to separate from it any oil that may have been discharged by the compressor along with the refrigerant vapor. An oil return pipe connecting the oil separator to the compressor is not shown.

The still hot refrigerant vapor flowing in discharge line 22 then passes in heat transfer relation to the water stored in tank 74 through the medium of heat exchange coil 72. Coil 72 may be immersed within the tank as shown or in an alternate construction be strapped or otherwise placed in heat transfer relation to the tank wall. The water in tank 74 is heated by the hot refrigerant vapor passing through coil 72 and the vapor is cooled. The heated water stored in tank 74 is employed for any purpose for which heated water is required, thereby saving the cost of fuel energy which would otherwise be required. Among the purposes to which the heated water is applicable are reheating air discharged by an air conditioning coil for lowering humidity in the air conditioned space, or for preheating service water before entry into a boiler or other heater.

Where air cooled condensers are employed outdoors, it is common to provide means for maintaining a high condensing temperature during cold outdoor conditions by flooding one or more of the condensers with liquid refrigerant, thereby reducing their capacity. Other methods have been generated whereby condenser fans are started and stopped to control the condensing pressure. Sill other arrangements employ solenoid valves to shut off discharge gas flow to one or more condensers to effectively eliminate them as condensers. Unfortunately, all of the aforementioned condenser control systems, including fan control, cause significant volumes of liquid refrigerant to reside in one or more of the condensers, thereby either requiring a sharply increased system charge or causing system malfunction.

The system described herein affords significant condenser capacity control without the defect of requiring extra refrigerant. Two air cooled condensers 66 and 68 are shown, though the control arrangement disclosed may be applied to any number of parallel condensers or circuits within a single condenser. These condensers may be housed within a single housing (split condenser) or be physically separate. These condensers are positioned to be subject to the cooling effect of outdoor air. During periods of high outdoor air temperature both (all) condensers operate in parallel. During periods of low outdoor temperature only condenser 66 is employed. Discharge refrigerant vapor is supplied to both condensers 66 and 68 via discharge line 22 and discharge branch lines 22-A and 22-B. Branch line 22-A is permanently connected to condenser 66. Discharge branch line 22-B is connected to condenser 68 by way of three-way valve 76. During summer conditions three way valve 76 acts to connect discharge branch line 22-B to condenser 68 through its inlet connection 68-I by way of valve internal passage 76-S and to close any connection to suction line 46. Under winter conditions the internal mechanism of three way valve 76 is caused to shift causing the inlet connection 68-I to be connected to suction line 46 by way of internal passage 76-W and for conduit 22-B to be closed to flow. Check valve 78, positioned in condenser outlet conduit 31-B which freely allows from condenser outlet 68-O during summer but during winter prevents refrigerant in conduit 31 from flowing backward into condenser 68. The effect of connecting condenser 68 to the suction conduit 46 during the winter is to retain the pressure within condenser 68 at a low level, thereby ensuring that refrigerant liquid does not collect in condenser 68 during winter periods.

The hot liquid refrigerant flowing from condensers 66/68 passes through condenser outlet conduit 31 and enters liquid supply manifold 90 to which branch condenser outlet conduits 31 are connected. Each such branch is connected either to a single evaporator as shown in FIG. 1 or to a multiplicity of evaporators as shown in FIG. 3 and in this FIG. 7. Expansion valves 30-A and 30-B are provided to reduce the pressure and temperature in each branch as appropriate. Each expansion valve 30 is equipped with a control line 92 through which pressure or electrical impulses are provided to cause each expansion valve to open, remain static or close.

The liquid refrigerant having passed through expansion valve 30 and now reduced in temperature and pressure, flows to a "relay" or distributor 50 which divides the flow as required to each of the evaporators 42 as required. The refrigerant enters each evaporator 42 through its inlet connection 41 (41-A, etc). As shown in FIG. 3, manual adjustment valves 56 may be provided to proportion the refrigerant flow to each evaporator in accord with its requirements. Within each evaporator, the liquid refrigerant is evaporated during its passage therethrough, thereby cooling the media such as air or brine, positioned in heat transfer relation to each evaporator. Having evaporated all the refrigerant liquid, only vapor flows from each evaporator into the common suction line 46, and is thereby returned to compressor 20 for recompression and recycling.

The portion of the condenser inlet conduit 31 which is connected to the evaporator inlet, the evaporator inlet portion 34, is identified to distinguish it from the condenser outlet portion 33. In accord with the principles of the invention, the liquid manifold and expansion valve 30 are positioned within the defined condenser outlet portion of condenser outlet conduit 31. Though FIG. 7, for schematic clarity, shows expansion valve 30 nearer to evaporators 42, in practice liquid manifold 90 and expansion valves 30 would be positioned substantially adjacent to the condenser outlets 66-O and 68-O in order to most effective minimize refrigerant charge retained or flowing in the conduit connecting the expansion valve 30 with the evaporator inlet. However, as described above, it is the intention of the inventor to retain as his intellectual property the right to bar others from installing the expansion device 30 anywhere along the condenser outlet portion 33 of condenser outlet conduit 31, thereby leaving them the right to continue to install expansion valves in their traditional portion in the conduit portion 34 directly connected to the inlet 41 of evaporator 42.

Wherever an evaporator is employed to cool air to a temperature colder than about 50 F., refrigerant within the evaporator must have a temperature colder than 32 F., the freezing point of water. Such cold refrigerant within the evaporator causes frost to form on the air-cooling surfaces. As such frost accumulates, it forms an insulating layer between the air to be cooled and the cold refrigerant, thereby reducing the refrigerating effectiveness of the evaporator. Therefore some means of periodically warming the evaporator is required. To achieve this objective within the context of the present invention, a hot gas conduit 82 is provided to periodically convey hot refrigerant vapor from discharge line 22 to an evaporator 42, thereby heating the evaporator 42 and thawing frost deposited thereon. Two faults of well known hot gas defrost systems are: first, the tendency of hot gas supplied to such evaporators to condense to a liquid refrigerant and return to compressor 20 via suction line 46 thereby diluting the oil in the compressor and possibly causing compressor damage; and second, the tendency of the initial rush of discharge gas to the cold evaporator at the beginning of defrost to cause the highside pressure, and especially the pressure in liquid manifold 90, to drop so sharply that liquid refrigerant flow through the expansion valve 30 to the non-defrosting evaporator is sharply reduced.

The present invention avoids both such problems and still provides an effective and speedy defrost by hot gas defrost conduit or line 82 in which is positioned pressure control valve 84. Pressure control valve 84 is set to maintain a pressure at its outlet, corresponding to temperature lower than 32 F., the freezing point of water. Since the gas flowing to the evaporators is thermally hot, the reduced pressure does not significantly impede the defrost, and the defrost proceeds with little if any condensation of liquid refrigerant within the defrosting evaporator. Further, the restricting and modulating effect of control valve 84 prevents a rush of gas to defrosting evaporator, thereby preventing the pressure in the highside and in the liquid manifold 90 from dropping so sharply that significant flashing of the liquid in the manifold 90 occurs. Where more than one group of evaporators is to be defrosted at various times, a hot gas manifold 86 is provided from which branch conduits 87-A and 87-B are connected to the outlet side of expansion valves 30. Hot gas solenoid valves 88, positioned in each branch conduit, are timed in accord with a timer or other program to periodically open and allow the flow of hot gas from discharge conduit 22 to each evaporator inlet 41 by way of pressure regulator 84 and evaporator inlet portion 34.

When the defrost of an evaporator or an evaporator group has been completed, a temperature or time sensor causes hot gas solenoid 88 to close, thereby returning the system to normal refrigeration.

From the foregoing description, it can be seen that the present invention comprises an improved system for providing effective refrigeration to distant evaporators employing minimum refrigerant charge. The invention further teaches control means for allowing the application of air cooled condensers subject to outside conditions without employing any of the condenser pressure control arrangements which intentionally or inadvertently log excess refrigerant within such outdoor condensers. The invention further provides a system for rapidly and effectively defrosting the evaporators which may collect frost, with little or no risk of liquid refrigerant condensing during the defrost operation and flooding back to and damaging the compressor/s. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims.

I claim:

1. An improved compression type refrigeration system having reduced refrigerant charge, said system having a serially conduit connected compressor, condenser having an outlet and at least two evaporators having inlets, said evaporators being positioned remotely from the condenser, condenser outlet conduit means having an overall length for conveying a flow of refrigerant from the condenser outlet to the evaporator inlets, and an expansion valve having an external sensor for controlling the flow of refrigerant to the evaporator inlets, said expansion valve being located at a position remote from the evaporators, whereby the reduction of refrigerant charge is achieved.

2. A compression type refrigeration system as recited in claim 1, further providing that the remote position of the expansion valve in the condenser outlet Conduit is between the approximate midpoint of said overall conduit length and the condenser outlet.

3. A compression type refrigeration system as recited in claim 1, further providing a branch in the condenser outlet conduit, means positioned at said branch for dividing the flow, and a branch conduit connecting each evaporator inlet with said means.

4. A compression type refrigerating system as specified in claim 3 further providing that the dividing means is positioned between the expansion valve and the evaporator inlets.

5. A compression type refrigeration system as recited in claim 4, further providing: means positioned in at least one branch connecting an evaporator inlet with the dividing means for adjusting the relative flows among the branches.

6. A compression type refrigeration system as recited in claim 3, further providing that the dividing means includes a vessel having an inlet and a number of branch outlets.

7. A compression type refrigeration system as recited in claim 6 further providing that the dividing vessel has a cylindrical shape and the inlet is axially positioned at one end of the vessel, and the branch outlets are positioned around the cylindrical portion, the angular distance in degrees between adjacent branch outlets being defined by 360 divided by the number of outlets.

8. A compression type refrigerating system as recited in claim 6, further providing that the vessel has therein a packing material.

9. A compression type refrigerating system as recited in claim 8, further providing that the packing material within the vessel comprises a multiplicity of randomly packed tubing pieces.

10. A compression type refrigerating system as recited in claim 9 further providing that each tubing piece has an outside diameter of 3/16 inch and a length of 0.5 inch.

11. A compression type refrigerating system as recited in claim 1, further providing a water storage vessel, said vessel having a portion of the conduit serially joining the compressor and the condenser positioned in heat transfer relation thereto, whereby the water in the vessel is heated.

12. A compression type refrigerating system as recited in claim 1, further providing hot gas defrosting means for defrosting said evaporators, said defrosting means comprising a conduit connecting the compressor discharge conduit to a point in the condenser outlet conduit.

13. A compression type refrigerating system as recited in claim 12 further providing that the point of connection of the hot gas defrosting conduit is between the expansion valve and the branch.

14. A compression type refrigerating system as recited in claim 13 further providing pressure regulating valve means positioned in said hot gas defrosting conduit for allowing the flow of hot gas to the defrosting evaporators while restricting the flow to maintain a pressure in said defrosting evaporators not exceeding the pressure corresponding to a temperature of 32 F. for the refrigerant employed.

15. A compression type refrigeration system having a serially conduit connected compressor, condenser having an outlet and at least two evaporator having inlets, said evaporators being positioned remotely from the condenser, condenser outlet conduit means having an overall length for conveying a flow of refrigerant from the condenser outlet to the evaporator inlet, said condenser outlet conduit means having two portions; a first portion connected to the condenser outlet, said first portion having a first length equal to 90 percent of the overall length of the condenser outlet conduit, and a second portion connected to the evaporator inlet, and expansion means for restricting and controlling the flow of refrigerant to the evaporator inlets, said expansion means being located at a position within the first portion, and further providing a branch in the condenser outlet conduit, and means positioned at said branch for substantially dividing the flow from the condenser outlet to each evaporator, said dividing means comprising a cylindrical vessel having an inlet axially positioned at one end of said vessel, said vessel having therein a packing material comprising a multiplicity of randomly packed tubing pieces, said vessel having a number of branch outlets positioned around the cylindrical portion, the angular distance in degrees between adjacent branch outlets being defined by 360 divided by the number of outlets.

16. An improved compression type refrigeration system having reduced refrigerant charge, said system having a serially conduit connected compressor, a condenser having an outlet and at least two evaporators having inlets, said evaporators being positioned remotely from the condenser, condenser outlet conduit means for conveying a flow of refrigerant from the condenser outlet to the evaporator inlets, said condenser outlet conduit means having a branch point with branch conduits connecting the branch point with the evaporator inlets, an expansion valve having an external sensor for controlling the flow of refrigerant to the evaporator inlets, said expansion valve being positioned remotely from the evaporators and between the condenser outlet and the branch point, whereby the reduction of refrigerant charge is achieved.

17. An improved compression type refrigerating system having reduced refrigerant charge, said system including a condenser having an outlet and at least two evaporators having inlets and a flow conduit connecting the condenser outlet with the evaporator inlets, said improvement comprising an expansion valve positioned remotely from the evaporators.

18. The method of constructing a compression type refrigerating system requiring reduced refrigerant charge, said system including a condenser having an outlet, an evaporator having an inlet, conduit means having an overall length connecting the condenser outlet with the evaporator inlet for allowing flow thereto, and an expansion valve having an external sensor, said method comprising the step of positioning the expansion valve in said flow conduit means at a position remote from the evaporator inlet.

19. The method of constructing a compression type refrigerating system as recited in claim 18, further providing that the step includes the positioning of the expansion valve substantially adjacent the condenser outlet.

20. A method of construction a compression type refrigerating system as recited in claim 18, further providing that step includes positioning the expansion valve between the approximate midpoint of said overall conduit length and the condenser outlet.

21. An improved compression type refrigeration system having reduced refrigerant charge, said system having a serially conduit connected compressor, condenser having an outlet and an evaporator having an inlet, said evaporator being positioned remotely from the condenser, condenser outlet conduit means having an overall length for conveying a flow of refrigerant from the condenser outlet to the evaporator inlet, and an expansion valve having an external sensor for controlling the flow of refrigerant to the evaporator inlet, said expansion valve being located at a position remote from the evaporator, whereby the reduction of refrigerant charge is achieved.

22. A compression type refrigeration system, as recited in claim 21, further providing that the expansion valve is positioned in condenser outlet conduit means between the condenser outlet and the approximate midpoint of the overall length of the condenser outlet conduit means.

23. An improved refrigeration system as recited in claim 22, further providing that the location of the expansion valve is at a position substantially adjacent the condenser outlet.

24. A compression type refrigerating system as specified in claim 21, further providing at least two evaporators each having an inlet, a branch in the condenser outlet conduit, and means positioned at said branch for dividing the flow from the condenser outlet to each evaporator, said dividing means having an inlet, and a branch conduit connecting each evaporator inlet with said dividing means.

25. An improved refrigeration system as recited in claim 24, further providing that the expansion valve position in the condenser outlet conduit is between the approximate midpoint of said overall conduit length and a position substantially adjacent the condenser outlet.

26. A compression type refrigerating system as specified in claim 25 further providing that the dividing means is positioned between the expansion valve and the evaporator inlets.

* * * * *